US010478977B2

(12) United States Patent
Rohrbach

(10) Patent No.: US 10,478,977 B2
(45) Date of Patent: Nov. 19, 2019

(54) UTILITY KNIFE

(71) Applicant: MARTOR KG, Solingen (DE)

(72) Inventor: Martin Rohrbach, Goeggingen (DE)

(73) Assignee: MARTOR KG, Solingen (DE)

( * ) Notice: Subject to any disclaimer, the term of this patent is extended or adjusted under 35 U.S.C. 154(b) by 89 days.

(21) Appl. No.: 15/654,217

(22) Filed: Jul. 19, 2017

(65) Prior Publication Data

US 2018/0021964 A1 Jan. 25, 2018

(30) Foreign Application Priority Data

Jul. 21, 2016 (DE) ..... 10 2016 008 724

(51) Int. Cl.
*B26B 5/00* (2006.01)
*B26B 1/08* (2006.01)

(52) U.S. Cl.
CPC ..... *B26B 5/003* (2013.01); *B26B 1/08* (2013.01); *B26B 5/001* (2013.01)

(58) Field of Classification Search
CPC .. B26B 5/00; B26B 1/08; B26B 5/001; B26B 5/003
USPC ..... 30/162
See application file for complete search history.

(56) References Cited

U.S. PATENT DOCUMENTS 4,899,443 A 2/1990 Beermann
6,550,144 B1 * 4/2003 Berns ..... B26B 5/003 30/162
7,765,701 B2 * 8/2010 Okada ..... B26B 5/003 30/162
8,353,109 B2 * 1/2013 Rohrbach ..... B26B 5/003 30/162
8,468,702 B2 * 6/2013 Doeren ..... B26B 5/003 30/162
8,707,566 B2 * 4/2014 Rohrbach ..... B26B 5/003 30/151
8,732,957 B2 * 5/2014 Rohrbach ..... B26B 5/003 30/154
8,752,297 B2 * 6/2014 Rohrbach ..... B26B 5/003 30/154
2006/0130340 A1 * 6/2006 Berns ..... B26B 5/003 30/162
2007/0245569 A1 * 10/2007 Yu Chen ..... B26B 3/00 30/143
2009/0106983 A1 * 4/2009 Berns ..... B26B 5/003 30/162
2012/0311870 A1 * 12/2012 De ..... B26B 5/001 30/162
2013/0091712 A1 * 4/2013 Schekalla ..... B26B 5/003 30/162
2015/0258695 A1 * 9/2015 Schekalla ..... B26B 5/001 30/162
2016/0229074 A1 * 8/2016 Rohrbach ..... B26B 5/00
(Continued)

FOREIGN PATENT DOCUMENTS

EP 2 716 421 A1 * 4/2013
EP 3 272 477 A1 * 1/2018
WO WO 2011/157262 A3 * 12/2011

*Primary Examiner* — Hwei-Siu C Payer
(74) *Attorney, Agent, or Firm* — Andrew Wilford

(57) ABSTRACT

A utility knife has a housing, a blade, and a blade support carrying the blade and supported on the housing so as to be displaceable in a straight line with the blade between a safety position, a cutting position, and a blade-change position. A torsion spring biases the blade into the safety position.

11 Claims, 7 Drawing Sheets

(56) References Cited

U.S. PATENT DOCUMENTS

| | | | | |
|---|---|---|---|---|
| 2017/0129112 | A1* | 5/2017 | Ranieri | B26B 5/001 |
| 2018/0021964 | A1* | 1/2018 | Rohrbach | B26B 1/08 30/162 |

* cited by examiner

UTILITY KNIFE

FIELD OF THE INVENTION

The invention relates to a utility knife. More particularly this invention concerns a knife having a housing that acts as a grip and a blade support that is supported displaceably on the housing so that a blade held on the blade support can be displaced between a safety position and a cutting position.

BACKGROUND OF THE INVENTION

A utility knife is described in DE 37 36 968 [U.S. Pat. No. 4,899,443] in which a guide member is received in a grip sleeve and carries a blade support such that it can be displaced between a safety position and a cutting position. A spring fastened to the guide member and to the blade support biases the blade support into the safety position. The blade is held in a seat between two plates of the blade support that can be moved to one another. The abutment of the plates against inner walls of the grip sleeve prevents the plates from being separated from each other and the blade from being removed from the seat. A blade change can be performed by pulling the guide member backward out of the grip sleeve with the blade support. The plates of the blade support can then be separated from one another, and the used blade can be replaced.

OBJECT OF THE INVENTION

It is the object of the invention to provide a utility knife in which a blade change can be performed more easily.

SUMMARY OF THE INVENTION

The object is achieved by a utility knife that comprises a housing with at least one housing opening. The housing forms a utility knife grip, for example. The knife comprises a blade that is held on a blade support. The blade support is supported on the housing such that it can be displaced in a straight line in the housing between at least one safety position, at least one cutting position, and at least one blade-change position. It should be borne in mind here that there can be several cutting positions depending on how far the user moves the blade out of the housing. Similarly, there can be several blade-change positions. Therefore, when the terms "cutting position" or "blade-change position" are used in the following, they refer—for the sake of example—to the cutting position or blade-change position in which the blade support is moved furthest forward.

In the cutting position, the blade extends out of the housing opening, and a cutting operation can be performed. In the blade-change position, the blade also extends out of the housing opening, and the blade support is moved further out of the housing compared to the cutting position. In the blade-change position, the blade can be removed from the blade seat. In the cutting position and/or in the safety position, it is not possible to remove the blade from the blade seat, for example.

In the safety position, the blade is retracted into the housing such that a cutting edge of the blade is inaccessible for the user. Here, too, it should be mentioned that there can be several safety positions. When the term "safety position" is used in the following, it is therefore referring—for the sake of example—to the safety position in which the blade support is fully retracted.

The blade support is biased by a spring into the safety position in all cutting positions, with the spring being formed as a torsion spring. That is, the blade support is retracted into the safety position as soon as a counterforce that holds the blade support in the cutting position is removed. For example, a prestress can be applied to the spring, so that it already biases the blade support in the safety position—against a stop, for example—and prevents the blade support from moving inadvertently out of the safety position.

A first leg of the spring is supported indirectly or directly on the blade support, for example, and a second leg of the spring is supported indirectly or directly on the housing. The coil of the spring can but need not be supported on the blade support or on the housing. The coil can also be supported in a floating manner.

In one embodiment, for example, the spring is supported on the blade support or on the housing. If the spring is supported on the housing, part of the spring is held securely against the housing, for example. If the spring is supported on the blade support, part of the spring is held securely against the blade support, for example.

A first leg of the spring is held rigidly against the blade support or against the housing, for example, and a second leg of the spring is designed to be displaceable and, when the blade support moves, is displaced from the safety position into the cutting position such that the spring is tensioned. The displaceable spring leg tensions the spring during movement from the safety position into the cutting position and is released when the blade support moves back toward the safety position. If the spring is supported on the housing, the first spring leg is held immovably on the housing, for example, and the second spring leg is in contact with the blade support, for example. If the spring is supported on the blade support, the first spring leg is held immovably on the blade support, for example, and the second spring leg is in contact with the housing, for example.

The spring is supported at least partly on a pin or in a hole, for example. In this case, the coil of the spring can simply be fitted onto the pin or into the hole.

The first leg is supported in a hole of the blade support or of the housing, for example. In this way, it is held immovably relative to the respective support member, i.e. blade support or housing.

According to one embodiment, at least one of the legs is supported on different surfaces of the housing or of the blade support as a function of the relative position between the blade support and the housing. For example, the respective bearing face can be a corner or a face. The bearing face can be formed indirectly or directly on the housing or on the blade support, for example. If the spring is supported on the housing, the bearing face can be associated with the blade support, for example. For example, if the spring is supported on the blade support, the bearing face can be associated with the housing. With this embodiment, the orientation of the surface can be used to influence how strongly and in what direction the blade support is biased by the spring.

The bearing face can be flat or curved. The movement of the respective leg from one bearing face to another bearing face can be continuous or discontinuous, for example, with a movement of the leg on a curved or flat surface being considered to be a continuous movement and a movement from a first bearing face to a second bearing face arranged at an angle to the first bearing face being considered to be discontinuous.

One embodiment is characterized in that at least one of the legs is supported in the safety position and/or in at least one cutting position on at least one first bearing face of the housing or of the blade support oriented such that at least a portion of the spring force biases the blade support toward the safety position. The first bearing face is oriented such that at least a portion of the spring force biases the blade support into the safety position. The first bearing face can also be part of a face, for example.

For example, in the safety position, one of the legs contacts a first bearing face whose planar surface is parallel to the direction of retraction of the blade support, and in the cutting position, it contacts a second bearing face whose planar surface forms an acute angle with the direction of retraction. In this way, the retraction force that acts on the blade support can be adapted to the corresponding positions of the blade support such that an optimal movement characteristic is achieved and the force for actuating the blade support and for holding the blade support in the cutting position is not perceived by the user as unpleasant.

In the blade-change position, for example, one of the legs is supported on at least one other bearing face, such as a third bearing face of the housing or of the blade support, that is oriented such that the blade support is not biased by the spring into the safety position. In this case, the blade support is biased in a direction other than toward the safety position. The second area of the face is oriented, for example, such that the spring force is aligned substantially transverse to the direction of retraction of the blade support. This means that the blade support is not retracted when the second leg is supported on the second area of the face.

According to an alternative embodiment, the blade support is biased in the blade-change position toward the safety position, but the force is not sufficient to move the blade support into the safety position.

According to one embodiment, the cutting position and/or the blade-change position is established by coacting stop faces of the blade support and of the housing. A first stop face and a second stop face are associated with the housing, for example. In the cutting position, a contact face of the blade support cooperates with the first stop face, and in the blade-change position, it cooperates with the second stop face. In other words, the blade support can be moved forward in the cutting position, for example, until the blade support comes into contact with the first contact stop face, which prevents further forward movement.

In addition or alternatively, the blade support—if the first stop face and/or the contact face is displaceable, for example—can be displaceable beyond the cutting position until it comes into contact in the blade-change position\with a second stop. By making the first stop face and/or the contact face displaceable, they can be moved out of the path of movement of the respective other surface. That is, the first stop face can be moved out of the path of movement of the contact face and/or the contact face can be moved out of the path of movement of the first stop face.

During movement of the blade support, the second spring leg travels between the safety position and the cutting position over an angle of about 30° to 50°, for example.

One embodiment is characterized in that at least one of the spring legs has a slide shoe. The slide shoe can be formed by the spring itself, for example, particularly by a bend with a convex contact area. According to an alternative, the slide shoe can be formed by a separate sliding or rolling member that is attached to the leg. In this way, the relative movement between the spring leg and the bearing face when the spring leg and bearing face come into contact is improved.

BRIEF DESCRIPTION OF THE DRAWING

Additional advantages of the invention are described with reference to an exemplary embodiment shown schematically in the figures in which.

SPECIFIC DESCRIPTION OF THE INVENTION

Figures 1A, 1B, 1C:
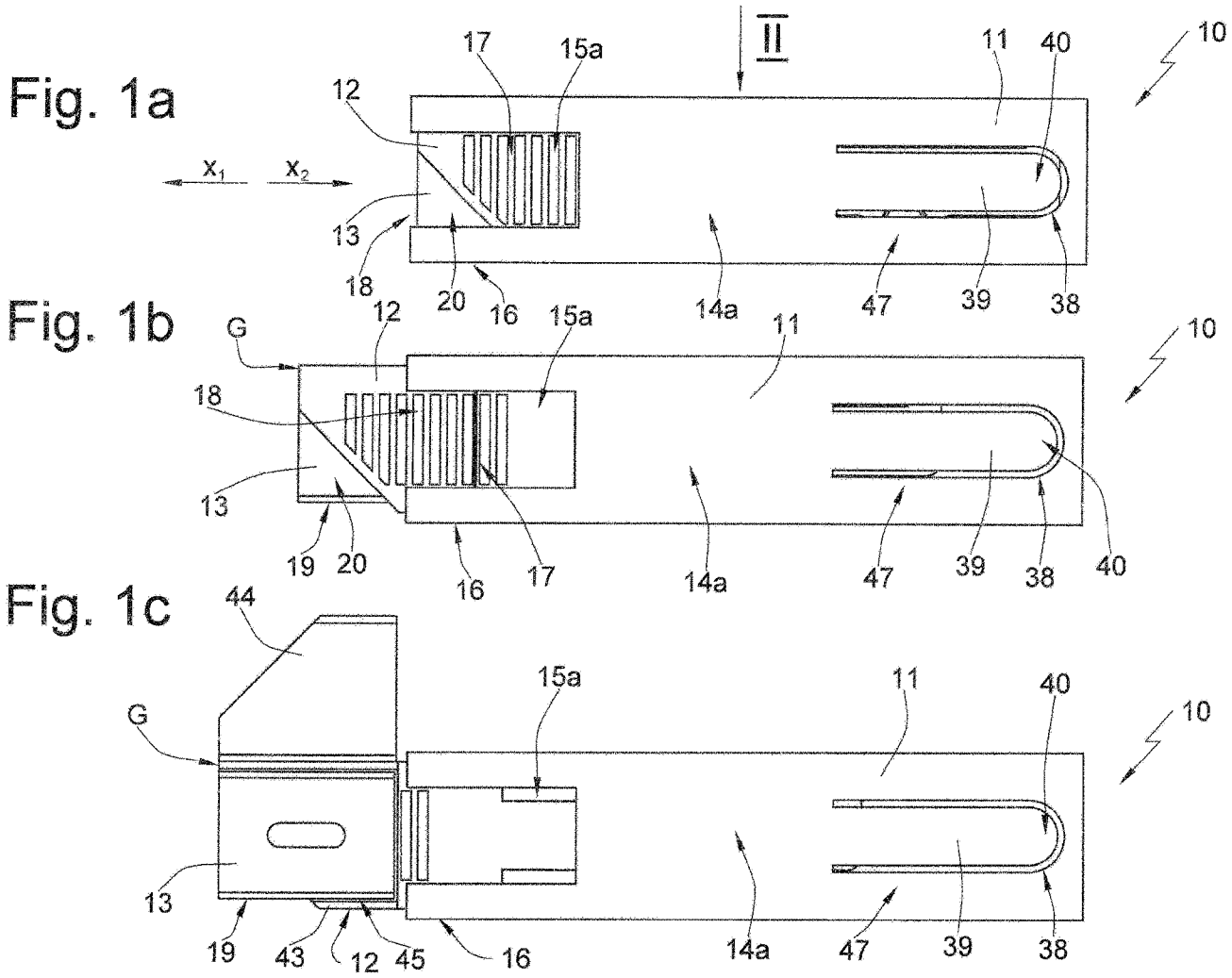
FIG. 1*a* is a side view of the knife in the safety position.
FIG. 1*b* is a side view of the knife in the cutting position.
FIG. 1*c* is a side view of the knife in the blade-change position.

A utility knife as a whole is shown in the drawing at 10. The same reference symbols in the various figures designate analogous parts, even if lowercase letters are added or omitted.

As can be seen in FIG. 1*b*, the knife 10 comprises a housing 11, a blade support 12, and a blade 13 with a cutting edge 19. In this embodiment, the blade support 12 has a body 43 with a seat 45 into which the blade 13 can be fit (for example, see FIG. 1*c*). A cover 44 holds down the blade 13 in a known form-fitting manner in the seat 45 between the body 43 and the cover 44. The cover 44 is connected by a hinge G with the body 43, for example.

According to an alternative, plastic can also be injected around the blade 13 during manufacture of the blade support, so that it is fixed permanently to the blade support. In this case, the blade 13 can only be replaced together with the blade support.

For example, FIG. 1*b* shows that the blade support 12 partially covers the blade 13, particularly the cutting edge 19 of the blade 13. A part 20 of the blade support 12 is cut away so that part of the cutting edge 19 is exposed in the cutting position.

The housing 11 can be made of a metal sheet or of plastic, for example.

Figures 1D, 1E, 1F:
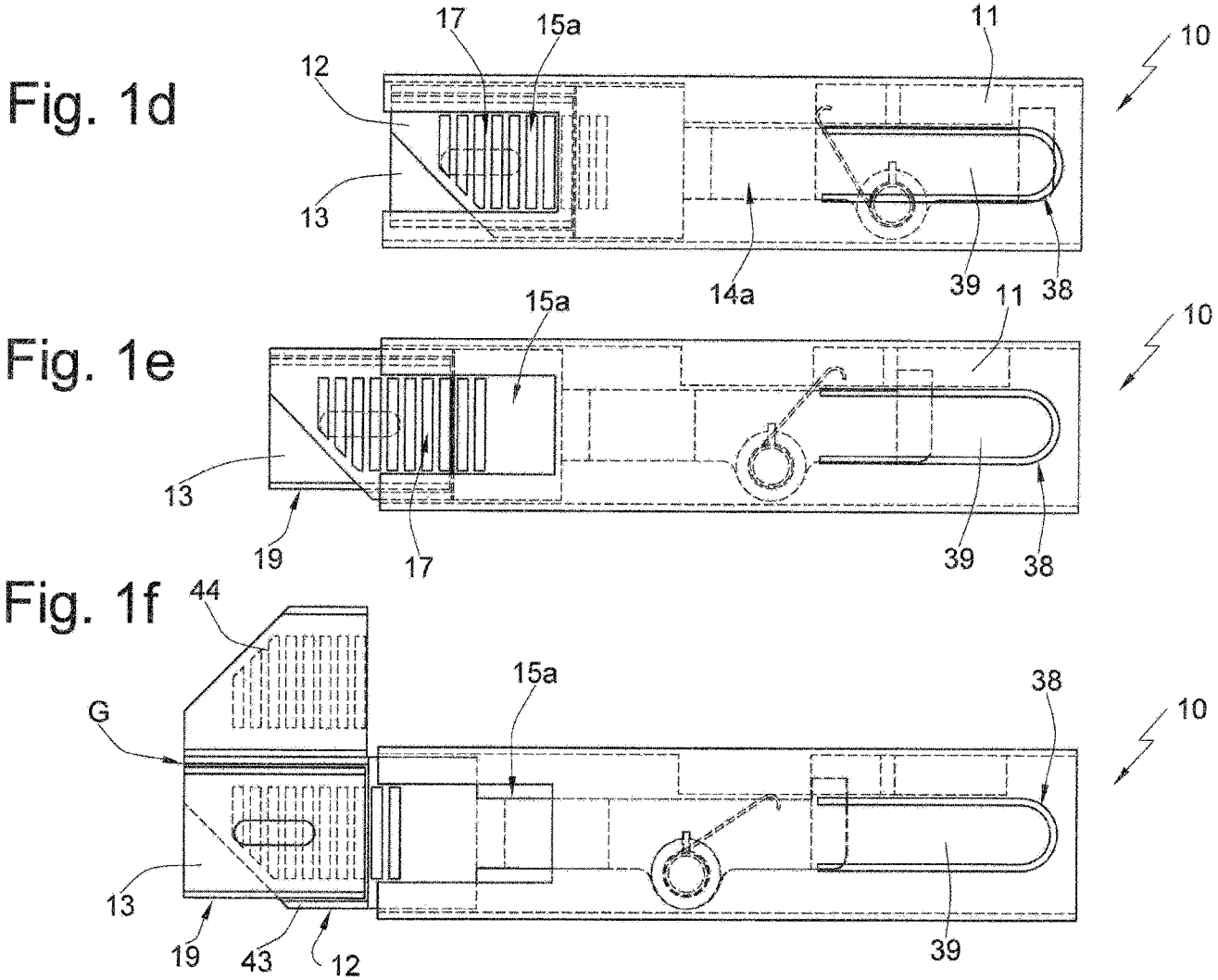
FIG. 1*d* is, like FIG. 1*a*, a side view of the knife in the safety position, with broken lines showing concealed structures.
FIG. 1*e* is, like FIG. 1*b*, a side view of the knife in the cutting position, with broken lines showing concealed structures.
FIG. 1*f* is, like FIG. 1*c*, a side view of the knife in the blade-change position, with broken lines showing concealed structures.

FIGS. 1*a* to 1*c* show various operating positions of the knife 10. FIG. 1*a* shows the knife 10 in the safety position. In FIG. 1*b*, the knife 10 is shown in the cutting position. In FIG. 1*c*, the knife 10 is shown in the blade-change position. FIGS. 1*d*, 1*e*, and 1*f* correspond to FIGS. 1*a*, 1*b*, and 1*c*, with the structure concealed by the housing 11 being represented by broken lines.

In the safety position according to FIGS. 1*a* and 1*d*, the blade support 12 is positioned such that the cutting edge of the blade 13 is inaccessibly covered by the housing 11, and the user cannot injure himself on the cutting edge 19.

The blade support 12 can be displaced from the safety position in a forward direction $x_1$ into the cutting position according to FIGS. 1*b* and 1*e* in which the blade projects out of the opening 18 at a front housing end 16 such that the cutting edge 19 of the blade 13 is accessible and a cutting operation can be carried out. According to FIGS. 1*b* and 1*e*, the blade support 12 is moved into the farthest forward cutting position. Additional cutting positions can be set up in which the blade support 12 and the blade 13 project out of the housing 11 and the cutting edge 19 is accessible, but the blade support 12 is not located in the frontmost cutting position.

The blade support 12 can be moved beyond the cutting position into a blade-change position that is shown in FIGS. 1*c* and 1*f*, for example. The blade support 12 is moved so far out of the housing 11 that the blade 12 can be removed from the blade support 12.

Figures 2, 3, 4:
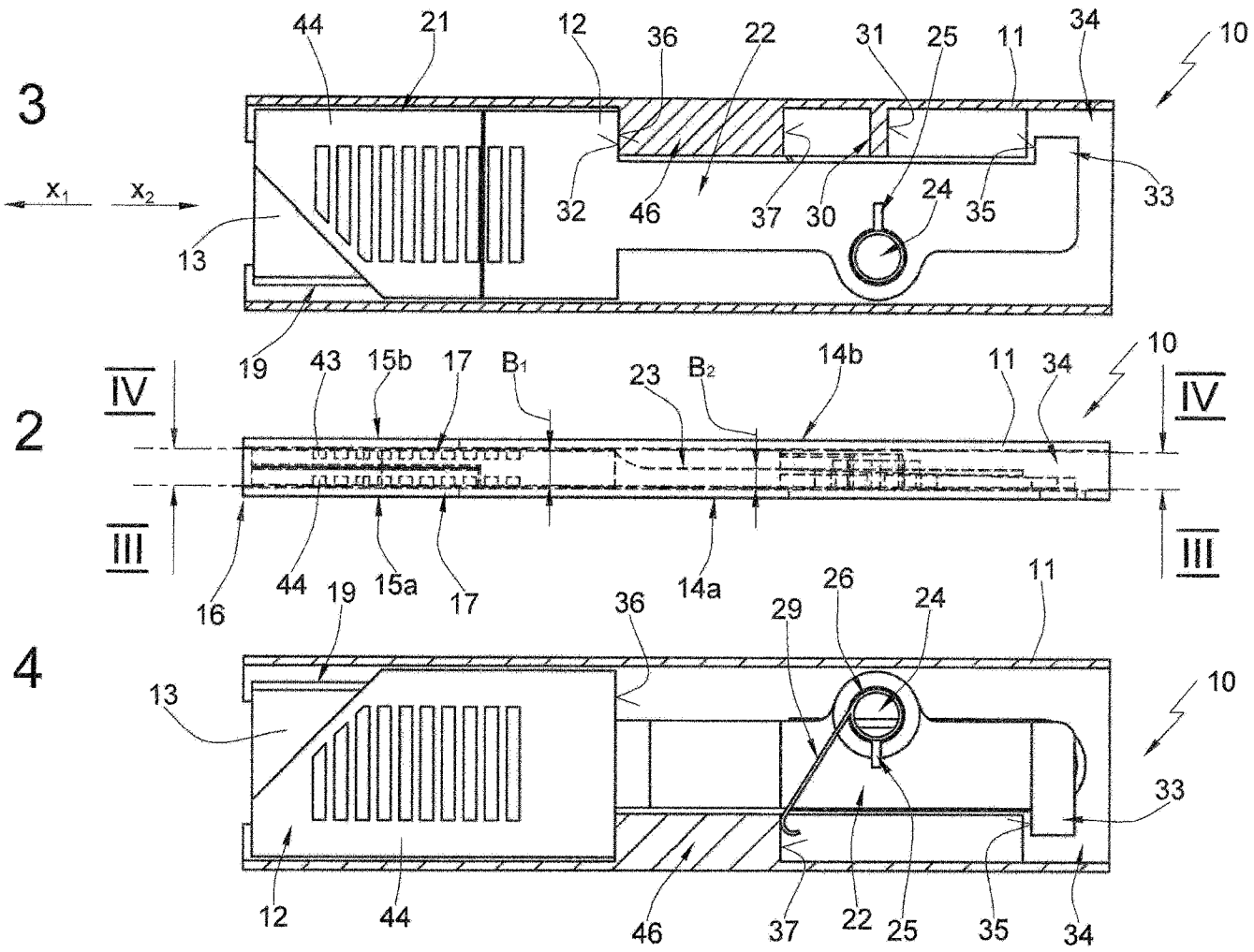
FIG. 2 is a view according to arrow II in FIG. 1*a*, with broken lines showing concealed structures.
FIG. 3 is a view according to section line III-III in FIG. 2.
FIG. 4 is a view according to section line IV-IV in FIG. 2.

The housing 11 has opposite side walls 14*a* and 14*b* (see FIG. 2). A cutout 15*a* is provided in the side wall 14*a*, and a cutout 15*b* is provided in the side wall 14*b*. The cutouts 15*a* and 15*b* are transversely across from one another and are open longitudinally toward the front housing end 16.

In a rear end region 47, the housing 11 has a U-shaped slot 38 that forms a tab 39 with a free end 40. The blade support 12 can be actuated through one or both cutouts 15*a* or 15*b*. For this purpose, the blade support 12 is provided on opposite sides with a grip structure 17 order to prevent the user's finger from slipping off.

In addition to a front end region 21 carrying the blade 13, the blade support 12 has a rear extension 22 (for example, see FIG. 3). A width $B_2$ of the extension 22 is reduced relative to a width $B_1$ of the front area 21. As a result of the reduced width $B_2$, a space 23 is formed in the housing 11. The blade support 12 has a hole 24 through the rear extension 22.

A torsion spring 26 has a coil and first and second legs 28 and 29. The coil 27 is supported coaxially in the hole 24 that thus forms a seat for the coil 27. The outside diameter of the coil 27 corresponds approximately to the inside diameter of the hole 24. The first leg 28 is connected with the extension 22 at an anchor formation 25 so as to be immovable relative to the blade support 12. In this embodiment, the anchor formation is formed by a slot in which the leg is immovably held. The second leg 29 projects into the space 23 and can move angularly therein.

According to FIG. 3, the housing 11 is provided with a projection 30 that forms a stop face 31. The projection 30 projects into an interior 34 of the housing 11. The extension 22 of the blade support 12 has a projection 33 extending transversely to a longitudinal axis. A contact face 35 of the projection 33 works together with the stop face 31 to establish the cutting position of the blade support 12 when moved fully forward in direction $x_1$. A contact face 36 of the blade support 12 works together with another stop face 32 of a projection 46 in order to establish the position of the blade support 12 that is moved fully back in direction $x_2$ (see FIG. 3).

A bearing face 37 of the housing projection 46 forms an abutment for the second spring leg 29. The bearing face 37 is oriented such that the spring force of the spring 26 biases the blade support 12 in the rearward direction $x_2$. The surface normal of the bearing face 37 is oriented so as to be parallel to direction $x_2$, for example. The leg 29 is located in a first position in which a slight pretension is applied to the spring 26. The leg 29 is prestressed against the first bearing face 37 of the projection 46.

Figures 5, 6, 7, 8, 9:
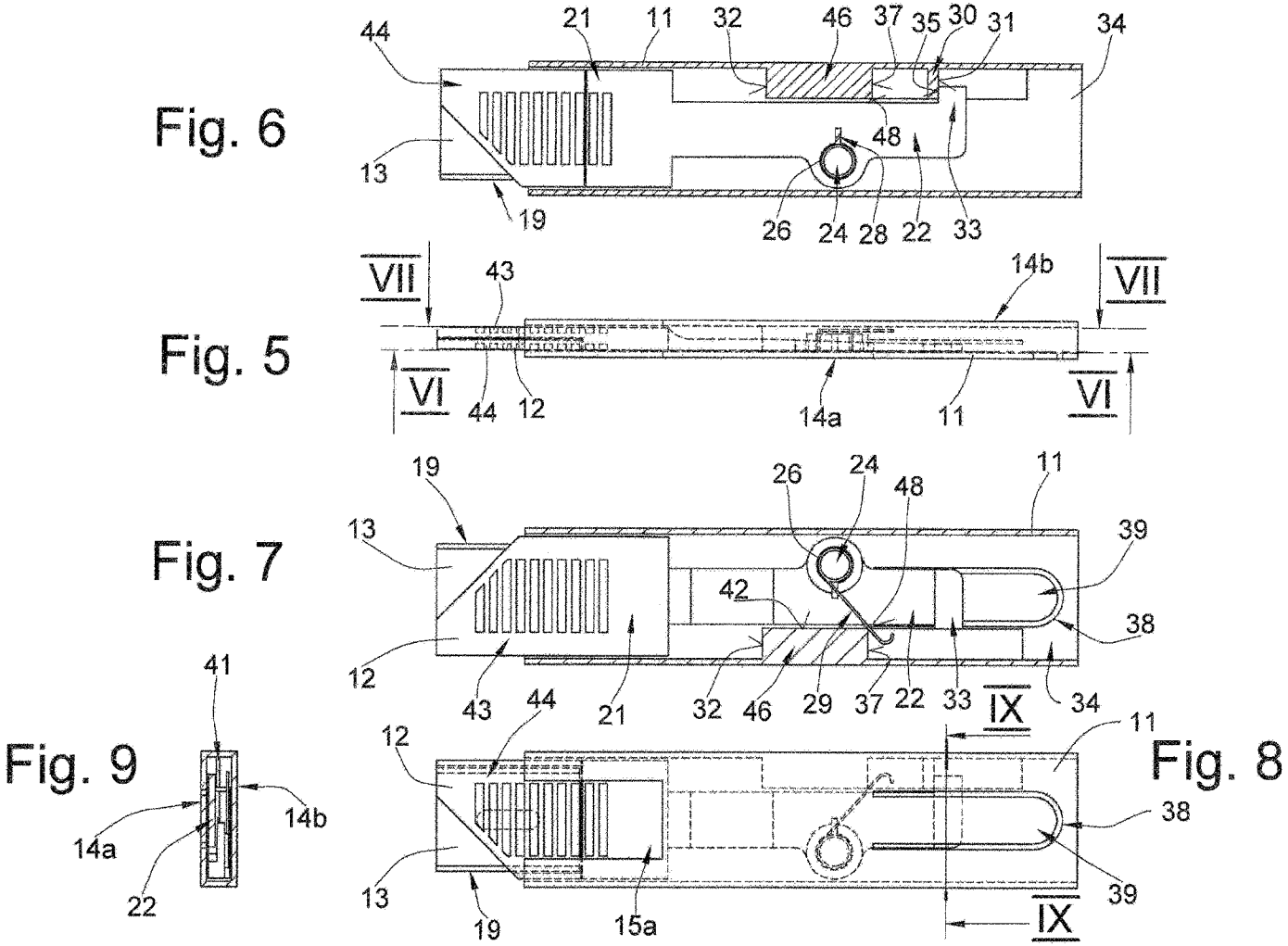
FIG. 5 is, like FIG. 2, a top view of the knife but with the blade support in the cutting position.
FIG. 6 is a section taken along line VI-VI in FIG. 5.
FIG. 7 is a section taken along line VII-VII in FIG. 5.
FIG. 8 is, like FIG. 1*e*, a side view of the knife in the cutting position.
FIG. 9 is a section taken along line IX-IX in FIG. 8.
Figure 10:
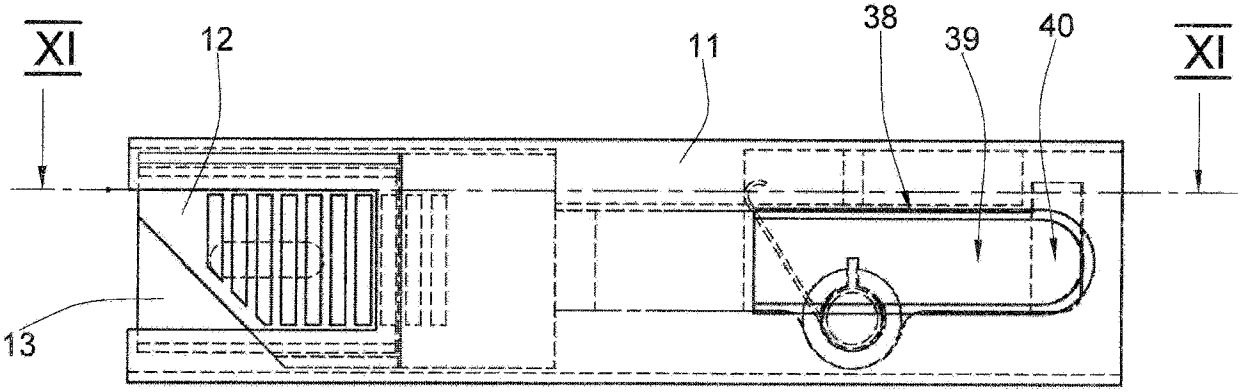
FIG. 10 is, like FIG. 1*d*, a side view of the knife in the safety position, with a tab of the housing actuated.

In the frontmost cutting position (for example, see FIGS. 5 to 9), the stop face 31 is in contact with the contact face 35. The leg 29 is in a second position after pivoting through approximately 50° with respect to the first position, so the spring 26 has been tensioned. The leg 29 is supported on a second bearing face 48 of the projection 46. One end of the leg 29 has slid on the projection from the bearing face 37 toward the bearing face 48 (see FIGS. 4 and 7). The bearing face 48 is oriented such that only a portion of the spring force of the spring 26 biases the blade support 12 in direction $x_2$. For example, the surface normal of the bearing face 48 is oriented at approximately a 45° angle to the surface normal of the first bearing face 37, so that only a portion of the spring force acts in the rearward retraction direction $x_2$. For the user, this offers the advantage that the force applied to hold the blade support in the cutting position is not unpleasant.

As the angle through which the leg 29 during the displacement of the blade support 12 between the safety position and the cutting position increases, the spring force of the spring 26 increases. But as a result of the shifting of the contact of the leg 29 from the bearing face 37 to the bearing face 48, the spring force does not increase proportionally.

According to an alternative embodiment, instead of the separate projections 30 and 46, it is also possible for only one projection to be provided that forms both the bearing face 37 and the stop face 31.

If the user would like to perform a cutting operation, he grasps the blade support 12 in the area of the structure 17 and moves it in the forward direction $x_1$ into the cutting position. In the cutting position, the cutting edge 19 is able to be placed onto the material to be cut, thus enabling a cutting operation to be performed. As soon as the holding force on the blade support is decreased, the spring 26 moves the blade support 12 with the blade 13 in rearward direction $x_2$ back into the safety position.

Figure 11:
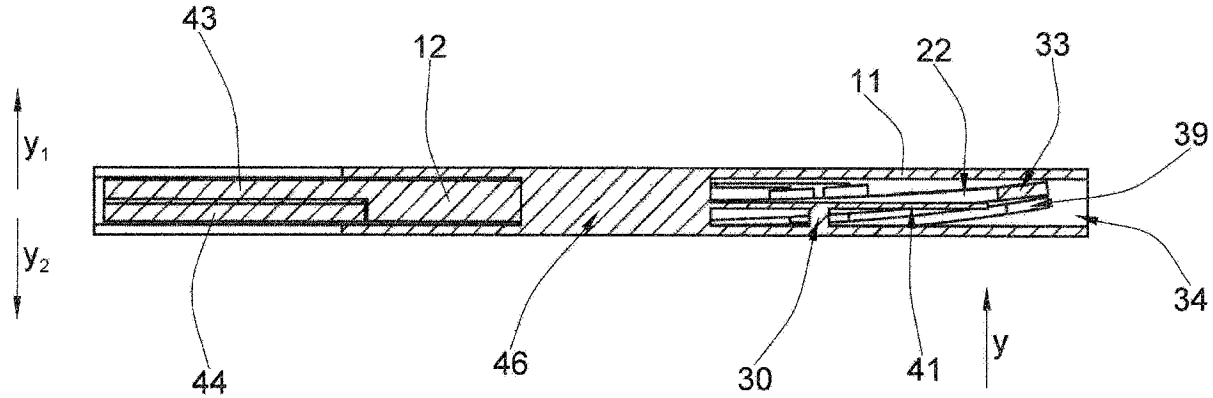
FIG. 11 is a section taken along line XI-XI in FIG. 10.

As can be seen particularly in FIG. 11, the projection 30 does not extend completely across the housing 11. The projection 30 is formed between the side wall 14*a* and a web 41 extending parallel to the side wall 14*a*. During normal operation of the knife 10, the projection 33 is located on a first movement path that is defined by the web 41 and the side wall 14*a*. The web 41 and the side wall 14*a* form a guide for the projection 33.

A force acting in a transverse direction $y_1$ on the tab 39 forces it elastically back in the direction $y_1$. The tab 39 contacts the extension 22 of the blade support 12 and deflects it in the direction $y_1$ as well (for example, see FIG. 11). If the blade support 12 is moved in the direction $x_1$ with the tab 39 actuated, the projection 33 travels onto a second path of movement that is defined by the web 41 and the side wall 14*b*. In other words, the projection 33 is guided on the second path of movement by the web 41 and the side wall 14*b*.

Figures 12, 13, 14, 15:
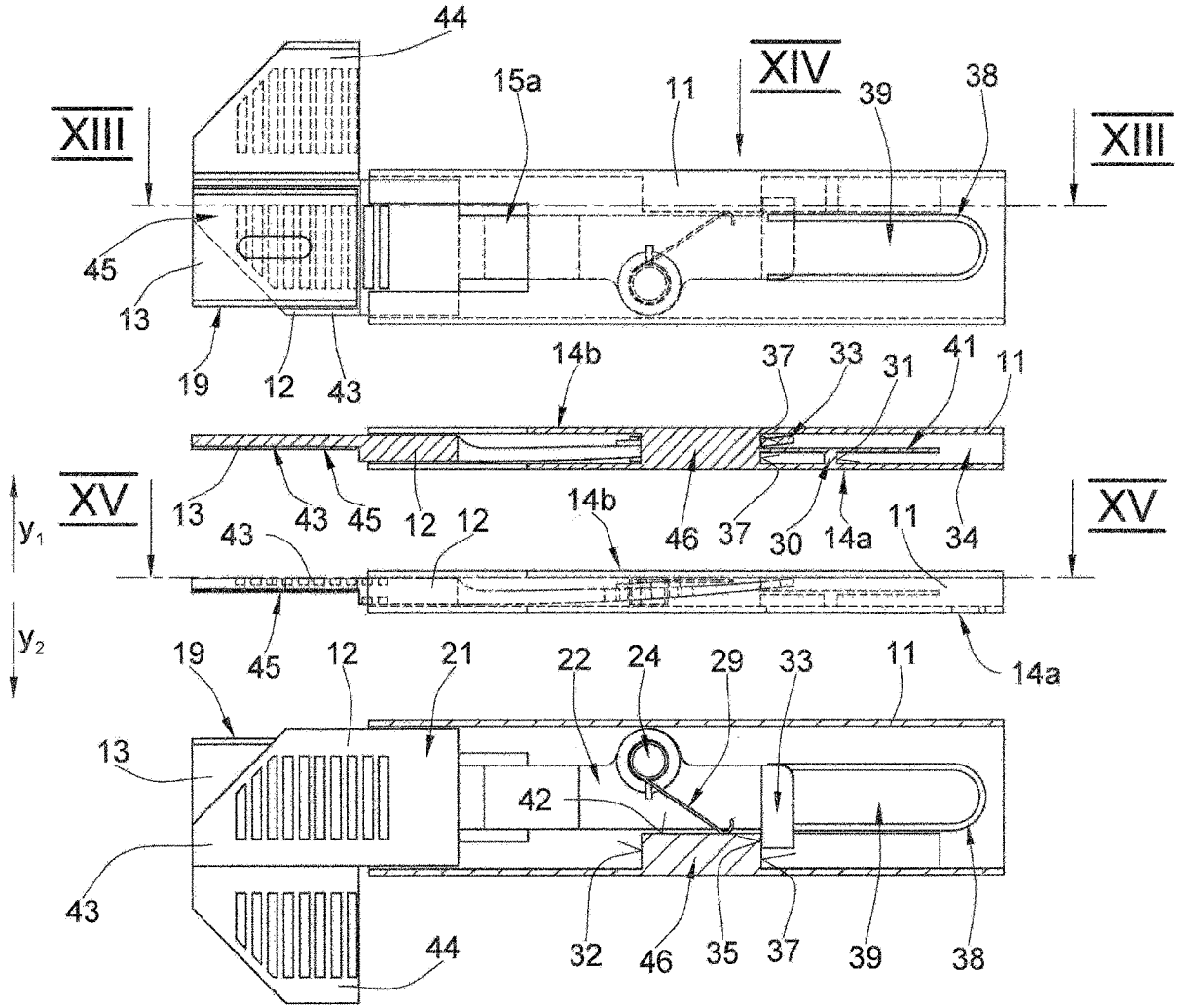
FIG. 12 is a view of the knife according to FIG. 1*f* in the blade-change position.
FIG. 13 is a section taken along line XIII-XIII in FIG. 12.
FIG. 14 is a top view of the knife according to arrow XIV in FIG. 12.
FIG. 15 is a section taken along line XV-XV in FIG. 14.
Figure 16:
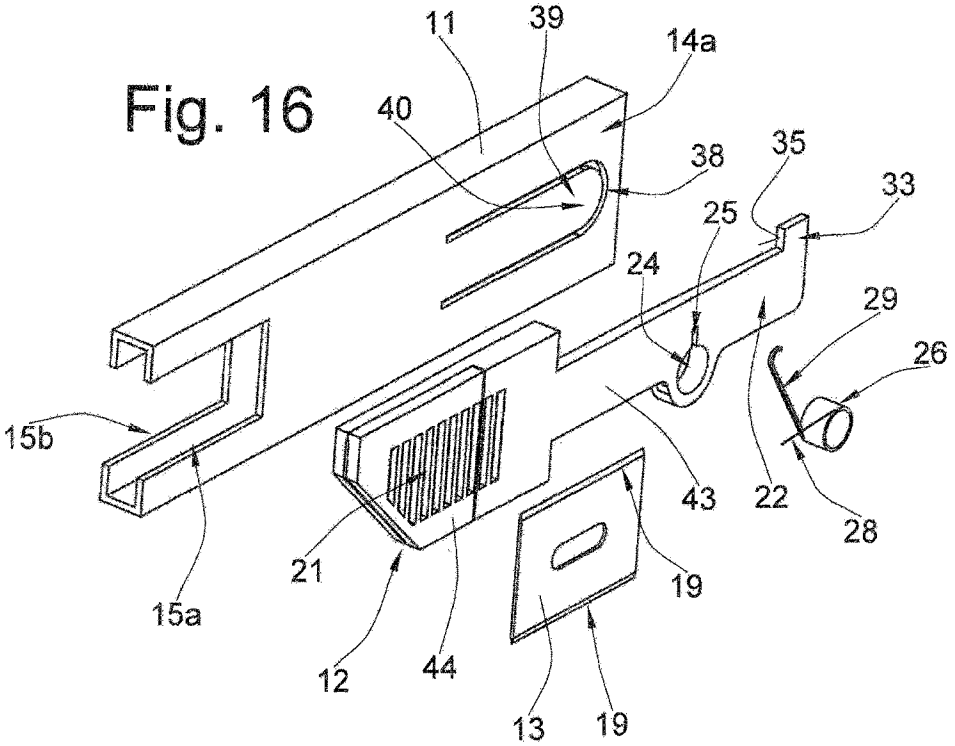
FIG. 16 is an exploded view of the knife.
Figure 17:
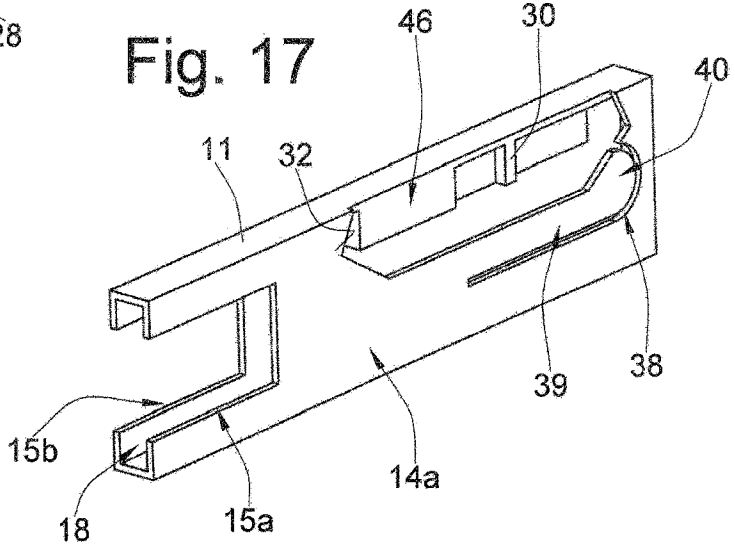
FIG. 17 is a perspective front view of the housing of the knife, with a portion of the housing wall cut away.

When the projection 33 is located on the second path of movement, the blade support 12 can be moved in the direction $x_1$ until the contact face 35 abuts against the bearing face 37 (for example, see FIGS. 13 and 15). Because the bearing face 37 is arranged so as to be further forward in the direction $x_1$ relative to the stop face 31, the blade support 12 can be moved further forward in the direction $x_1$ relative to the cutting position when the projection 33 is located on the second path of movement.

Displacement of the blade support 12 between the cutting position and the blade-change position, moves the leg 29 into contact with a third bearing face 42 of the projection. The bearing face 42 is arranged so as to be approximately at a right angle to the first bearing face 37. Since the bearing face 42 provides counterforces only in direction y but not in direction $x_2$, the blade support is not biased in direction $x_2$ when the leg 29 is in contact with the bearing face 42.

When the contact face 35 abuts against the bearing face 37, the blade-change position is reached and the leg 29 is in contact with the third bearing face 42. The cover 44 can then be pivoted relative to the body 43. A user can then perform a blade change without having to hold the blade support 12 in the blade-change position against a spring force or secure the blade support 12 in the blade-change position. Nevertheless, as will readily be understood, a locking device can be provided in the blade-change position that prevents the blade support 12 from moving out of the blade-change position, particularly in the rearward direction $x_2$.

If the blade support 12 is moved out of the blade-change position in direction $x_2$ into the safety position, the elastically deformed extension 22 returns to the first path of movement as a result of its restorative force in an opposite transverse direction $y_2$. The blade support can then again be moved in the forward direction $x_1$ only until the contact face 35 abuts against the stop face 31, which is the case in the cutting position. During the retraction of the blade support 12 out of the blade-change position in direction $x_2$ into the cutting position, the leg 29 also slides back again to rest against the bearing face 37.

The invention claimed is:

1. A utility knife comprising:
- a housing;
- a blade;
- a blade support carrying the blade and supported by and slidable in the housing so as to be displaceable in a straight line with the blade between a safety position, a cutting position, and a blade-change position; and
- a torsion spring biasing the blade support into the safety position and having a first leg supported on different surfaces of the housing or of the blade support in the safety, cutting, and blade-change positions of the blade support.

2. The knife defined in claim 1, wherein the torsion spring has a second leg supported on the blade support, the first leg being supported on the housing.

3. The knife defined in claim 1, wherein the spring is mounted on the blade support or on the housing.

4. The knife defined in claim 1, wherein the spring has a second leg fixed to the blade support or against the housing, and the first leg is displaceable, when the blade support moves, from the safety position into the cutting position such that the spring is tensioned.

5. The knife defined in claim 1, further comprising:
- a hole or pin supporting the spring and provided on the blade support or on the housing.

6. The knife defined in claim 5 wherein the spring has a second leg supported in the blade support or the housing.

7. The knife defined in claim 1, wherein, during displacement of the blade support between the safety position and the blade-change position, the first leg is supported on at least one bearing face of one of the different surfaces of the housing or of the blade support, the bearing face being oriented such that at least a portion of a spring force biases the blade support into the safety position.

8. The knife defined in claim 1, wherein the first leg is supported in the blade-change position on a bearing face of one of the different surfaces of the housing or of the blade support, with the bearing face being oriented such that the blade support is not biased by the spring into the safety position.

9. The knife defined in claim 1, wherein the first leg has a slide shoe.

10. A utility knife comprising:
- a housing;
- a blade;
- a blade support carrying the blade and supported by and slidable in the housing so as to be displaceable in a straight line with the blade between a safety position, a cutting position, and a blade-change position; and
- a torsion spring biasing the blade support into the safety position;
- a first stop face on the housing;
- a second stop face on the housing; and
- a contact face on the blade support and in contact with the first stop face in the cutting position and in contact with the second stop face in the blade-change position.

11. The knife defined in claim 10, wherein the contact face is associated with an area of the blade support that can be displaced between a first path of movement and a second path of movement, and the first stop face is associated with the first path of movement and the second stop face is associated with the second path of movement.

* * * * *